US006815913B2

(12) United States Patent
Wakita et al.

(10) Patent No.: US 6,815,913 B2
(45) Date of Patent: Nov. 9, 2004

(54) CATHODE RAY TUBE

(75) Inventors: Syoichi Wakita, Chiba (JP); Nobuyuki Suzuki, Oohara (JP); Toshio Nakayama, Shirako (JP); Yasuo Tanaka, Ichihara (JP); Kouichi Harasaka, Mobara (JP)

(73) Assignees: Hitachi, Ltd., Tokyo (JP); Hitachi Electronic Devices Co., Ltd., Chiba-ken (JP)

( * ) Notice: Subject to any disclaimer, the term of this patent is extended or adjusted under 35 U.S.C. 154(b) by 0 days.

(21) Appl. No.: 10/193,468

(22) Filed: Jul. 12, 2002

(65) Prior Publication Data

US 2003/0025437 A1 Feb. 6, 2003

(30) Foreign Application Priority Data

Jul. 30, 2001 (JP) ..... 2001-228871

(51) Int. Cl.[7] ..... H01J 29/58; H01J 29/50; H01J 29/46; H01J 29/72; G09G 1/04

(52) U.S. Cl. ..... 315/395; 315/382; 315/382.1; 313/412; 313/414; 313/446; 313/447; 313/448; 313/449; 313/458; 313/460

(58) Field of Search ..... 315/382, 382.1, 315/395, 402, 366, 366.15, 14, 15, 16; 313/412, 414, 446, 447, 448, 449, 458, 460, 451, 456, 457, 452

(56) References Cited

U.S. PATENT DOCUMENTS 4,142,128 A * 2/1979 Odenthal ..... 313/460
4,188,563 A * 2/1980 Janko ..... 313/460
4,350,924 A * 9/1982 Misono ..... 313/441
5,025,189 A * 6/1991 Son ..... 313/449
6,031,326 A 2/2000 Suzuki et al.
6,133,685 A 10/2000 Konda et al.
6,236,152 B1 * 5/2001 Kimiya et al. ..... 313/412
2002/0003394 A1 1/2002 Taguchi et al.

FOREIGN PATENT DOCUMENTS

| | | |
|---|---|---|
| JP | 21216/1987 | 5/1987 |
| JP | 10-074465 | 3/1998 |
| JP | 10-334824 | 12/1998 |
| JP | 2000-188067 | 4/2000 |

* cited by examiner

*Primary Examiner*—Nimeshkumar D. Patel
*Assistant Examiner*—Sharlene Leurig
(74) *Attorney, Agent, or Firm*—Milbank, Tweed, Hadley & McCloy, LLP

(57) ABSTRACT

The present invention provides a cathode ray tube which exhibits a favorable contrast by enhancing a speed modulation effect. A front-stage anode electrode and a focus electrode which constitute an electron gun are respectively divided into a plurality of portions. A plurality of portions of the divided front-stage anode electrode are arranged in the tube axis direction at given intervals and are electrically connected with each other. A plurality of portions of the divided focus electrode are arranged in the tube axis direction at given intervals and are electrically connected with each other. Due to gaps formed in the front-stage anode electrode and the focus electrode, the speed modulation effect is increased.

4 Claims, 12 Drawing Sheets

PRIOR ART

CATHODE RAY TUBE

BACKGROUND OF THE INVENTION

1. Field of the Invention

The present invention relates to a cathode ray tube which enhances a speed modulation effect.

2. Description of the Related Art

A color cathode ray tube, particularly a high brightness cathode ray tube such as a projection-type cathode ray tube forms images of high brightness and high definition on a phosphor screen by increasing electron beams (current) projected to a phosphor screen, by increasing an acceleration voltage applied to a final acceleration electrode (anode), and by elevating a potential of a focusing electrode.

Further, there has been known a method which changes a scanning speed of electron beams in response to a contrast level of images to display images having an excellent contrast (speed modulation method).

In this method, the scanning of electron beams is controlled such that when the electron beams perform horizontal scanning from a black level to a white level in response to a differential output of image signals, the scanning speed is temporarily accelerated and thereafter the scanning is temporarily stopped, while when the electron beams perform horizontal scanning from the white level to the black level in response to a differential output of image signals, the scanning is temporarily stopped and thereafter is temporarily accelerated.

A portion where the scanning speed is fast exhibits low electron beam density and hence, the portion is dark, while a portion where the scanning is stopped exhibits the high electron beam density and hence, the portion is bright. Accordingly, a region of black level is increased and, at the same time, a region of white level is narrowed so that the current density is increased where by the brightness is increased. Accordingly, the contrast is enhanced so that an image display of high quality is obtained.

An evacuated envelope of a cathode ray tube is constituted of a panel portion on which a phosphor screen is formed, a neck portion which houses an electron gun and a funnel portion which connects the panel portion and the neck portion.

FIG. 15 is a cross-sectional view of a neighborhood of a neck portion of a conventional cathode ray tube. An electron gun is housed in the neck portion 23. The electron gun is constituted of a cathode K, a first grid electrode (control electrode) 11, a second grid electrode (accelerating electrode) 12, a third grid electrode (front-stage anode electrode) 13, a fourth grid electrode (focus electrode) 14 and a fifth grid electrode (anode electrode) 15. A deflection yoke 6 is exteriorly mounted on a transitional region between the neck portion 23 and the funnel portion 22. Further, on an outside of the neck portion 23, a correction magnetic device 7 for convergence adjustment and color purity adjustment and a speed modulation coil 8 are exteriorly mounted.

Electron beams temporarily receive a positive deflection action (scanning direction) or a negative deflection action (direction opposite to scanning direction) in the horizontal scanning direction due to a magnetic field generated by the speed modulation coil 8.

An electric current which flows in the speed modulation coil8 has a high frequency and the fourth electrode 14 is constituted of nonmagnetic metal material such as stainless steel in the same manner as other electrodes and hence, when the magnetic field generated by the speed modulation coil 8 acts on the electrode 14, an eddy current is generated in the inside of the electrode 14.

The generation of a magnetic flux which acts in an inner space of the fourth electrode 14 is suppressed by this eddy current so that the speed modulation effect is reduced.

To make the speed modulation magnetic field effectively act on the electron beams, it has been known to divide the fourth electrode 14 into halves along an electron beam path. The divided halves of the fourth electrode 14 are electrically connected by a connection line.

Due to such a constitution, it is possible to perform the speed modulation by inserting the magnetic field of the speed modulation coil in the space of the fourth electrode 14 so that the highly efficient speed modulation can be realized.

Further, by elongating an interval in the tube axis direction of the two-split fourth electrode 14, the speed modulation magnetic field acts on the electron beams more effectively.

FIG. 16 is a side view of an electron gun adopting a speed modulation method. In the electron gun shown in FIG. 16, a portion of the fourth grid electrode 14 is inserted into the fifth grid electrode 15. In FIG. 16, parts which perform the same actions as the parts shown in FIG. 15 are indicated by the same numerals.

As publications which disclose the prior art related to this type of cathode ray tubes, for example, Japanese Laid-open Patent Publication 334824/1998, Japanese Laid-open Patent Publication 74465/1998 and Japanese Accepted Patent Publication 21216/1987 are named.

Further, a structure in which a coil-shaped portion is formed in a portion of a third grid electrode is disclosed in Japanese Laid-open Patent Publication 188067/2000.

In an electron gun which divides a focus electrode into halves in the tube axis direction, there exists a limit with respect to the expansion of a gap between the divided halves. When the gap between the divided halves of the electrode is excessively large, it is impossible to maintain the potential in the inside of the fourth electrode at an equal potential. That is, when the gap between the divided halves of the electrode is increased, the electron beams receive the influence of an electric field other than the electric field generated by electrodes of the electron gun or an external magnetic field. For example, the influence of electric fields from a charged with the front-stage anode electrode 13 by means of a connection line 181.

Since the front-stage anode 13 and the focus electrode 14 are respectively divided, an eddy current which is generated in the focus electrode 14 due to a magnetic field generated by the speed modulation coil 8 is reduced. Further, the magnetic field generated by the speed modulation coil 8 can easily enter the electron beam passing region so that a sufficient speed modulation effect can be obtained. Accordingly, a contrast of displayed images can be enhanced.

In FIG. 2, the front-stage anode electrode 13 has one gap and the focus electrode 14 has three gaps. However, the anode electrode 13 may have a plurality of gaps and the focus electrode 14 may have a single gap. In this embodiment, to make the speed modulation magnetic field permeate into the inside of the focus electrode 14 where the diameter of the electron beam becomes bold as much as possible, three gaps are formed in the inside of the focus electrode 14.

The third focus electrode 143 uses parts having the same shape as those of the second focus electrode 142.

In FIG. 2, A1 indicates a total length of the first front-stage anode 131, A2 indicates a total length of the second front-stage anode 132, B1 indicates a total length of the first focus electrode 141, B2 indicates a total length of the second focus electrode 142, B3 indicates a total length of the third focus electrode 143, B4 indicates a total length of the fourth focus electrode 144, C1 indicates the gap between the first front-stage anode 131 and the second front-stage anode 132, D1 indicates the gap between the first focus electrode 141 and the second focus electrode 142, D2 indicates the gap between the second focus electrode 142 and the third focus electrode 143, D3 indicates the gap between the third focus electrode 143 and the fourth focus electrode 144, E1 indicates an interval between the second front-stage anode 132 and the first focus electrode 141, $\phi 1$ indicates an inner diameter of the second front-stage anode electrode 132 and an inner diameter of the first focus electrode 141, and $\phi 2$ indicates an inner diameter of the large-diameter portion of the fourth focus electrode 144.

The length extending from a phosphor-screen-side end portion of the first front-stage anode 131 to a cathode-side end portion of the fourth focus electrode 144 (C1+A2+E1+B1+D1+B2+D2+B3+D3) is 20 mm. By setting the length extending from a phosphor-screen-side end portion of the first front-stage anode 131 to a cathode-side end portion of the fourth focus electrode 144 equal to the total length of the speed modulation coil 8, the magnetic field which is generated by the speed modulation coil 8 can be effectively utilized.

With the provision of cathode ray tube using the electron gun 5 having the constitution of this embodiment, the magnetic field generated by the speed modulation coil 8 effectively enters the gap formed in the front-stage anodes 13 and the gap formed in the focus electrode 14 and acts on the electron beam.

According to this embodiment, due to the gap formed in the front-stage anode electrode 13 and the gap formed in the focus electrode 14, the magnetic field of the speed modulation coil 8 can easily enter the electron beam passing region. Further, an eddy current generated at the front-stage anode electrode 13 and the focus electrode 14 is reduced so that the sufficient speed modulation effect is obtained. Further, the influence derived from the bead glass and the connector can be suppressed so that a contrast of images is enhanced whereby an image display of high quality is obtained.

Further, in this embodiment, a focus electrode which has a short length in the tube axis direction is used as the second focus electrode 142 and the third focus electrode 143, the generation of an eddy current in the focus electrode 14 can be suppressed. insulation supporting body (bead glass) or a connector is increased so that a cross-sectional shape of the electron beams is deformed.

Since the interval between the divided halves of the electrode can not be increased, it is difficult to ensure the sufficient entrance of the speed modulation magnetic field into the electron beam passing region.

Further, when the total length of the cathode ray tube is short, the total length of the neck portion is short. Accordingly, it is difficult to arrange the speed modulation coil at a site close to a main lens and hence, a sufficient speed modulation effect can not be obtained.

Further, when the total length of the electron gun is short, the total length of the focus electrode is short. Accordingly, it is difficult to provide the sufficient gap for obtaining the speed modulation effect.

SUMMARY OF INVENTION

A cathode ray tube according to the present invention includes an evacuated envelope which is constituted of a panel portion on which a phosphor screen is formed, a neck portion which houses an electron gun and a funnel portion which connects the panel portion and the neck portion.

A deflection yoke, a correction magnetic device for correcting a track of electron beams and a speed modulation coil are exteriorly mounted on the evacuated envelope.

In the electron gun, a plurality of electrodes including a cathode, a control electrode, an acceleration electrode, a front-stage anode electrode, a focus electrode and an anode electrode are arranged at given intervals in the tube axis direction of the cathode ray tube. Each electrode is fixed by having an electrode support body which is mounted on a side wall thereof embedded in an insulation support body.

The front-stage anode electrode is divided into a plurality of portions (electrodes) in the tube axis direction of the cathode ray tube. A plurality of divided portions of the front-stage anode electrode are arranged at given intervals in the tube axis direction of the cathode ray tube and are electrically connected by connection lines.

The focus electrode is divided into a plurality of portions (electrodes) in the tube axis direction of the cathode ray tube. A plurality of divided portions of the focus electrode are arranged at given intervals in the tube axis direction of the cathode ray tube and are electrically connected by connection lines.

Due to such a constitution, an eddy current which is generated in the focus electrode due to a magnetic field generated by the speed modulation coil is reduced. Further, the magnetic field generated by the speed modulation coil can easily enter an electron beam passing region so that a sufficient speed modulation effect can be obtained. Accordingly, a contrast of displayed images is enhanced.

According to the present invention, it is possible to provide a cathode ray tube which exhibits a favorable contrast by enhancing the speed modulation effect.

DESCRIPTION OF THE PREFERRED EMBODIMENTS

Preferred embodiments of a cathode ray tube according to the present invention are explained hereinafter in conjunction with attached drawings.

Figure 1:
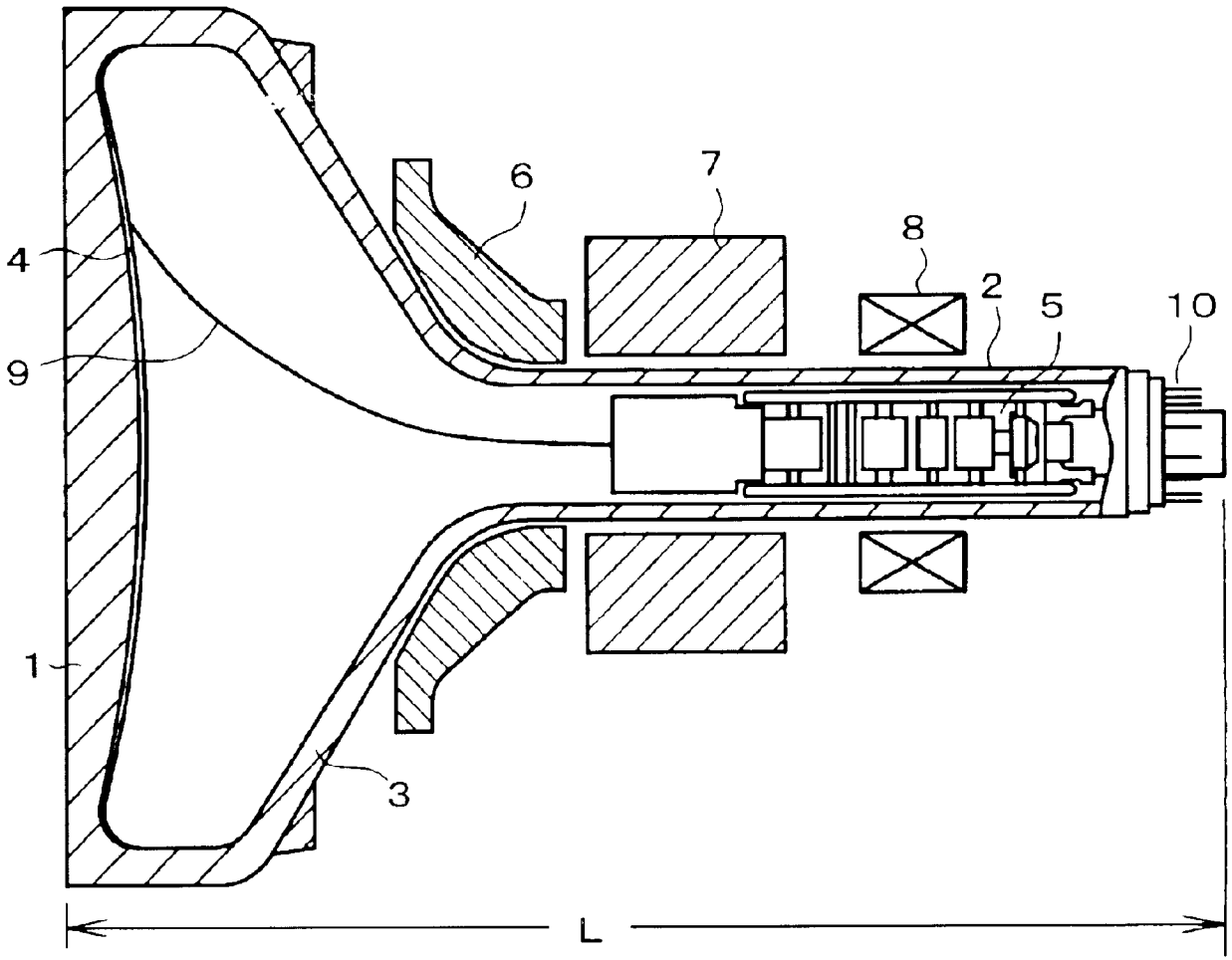
FIG. 1 is a cross-sectional view of a cathode ray tube according to the present invention.

FIG. 1 is a cross-sectional view of a cathode ray tube according to the present invention. This cathode ray tube is a monochroic projection type cathode ray tube (hereinafter simply referred to as "cathode ray tube".

In the cathode ray tube, an evacuated envelope is constituted of a panel portion 1 which forms a phosphor screen 4 on an inner surface thereof, a neck portion 2 which houses an electron gun 5 and a funnel portion 3 which connects the panel portion 1 and the neck portion 2. The phosphor screen 4 is constituted of a monochroic phosphor layer. The electron gun 5 irradiates an electron beam 9 for making a phosphor body emit light. L indicates a total length of the cathode ray tube.

On the evacuated envelope, a deflection yoke 6, a correction magnetic device 7 for correcting a track of the electron beams and a speed modulation coil 8 are exteriorly mounted.

The deflection yoke 6 is exteriorly mounted on a transitional region between the neck portion 2 and the funnel portion 3. The speed modulation coil 8 and the correction magnetic device 7 for convergence adjustment are exteriorly mounted on an outer periphery of the neck portion 2. These magnetic field generating devices are sequentially mounted in the order of the deflection yoke 6, the correction magnetic device 7 and the speed modulation coil 8 from the phosphor screen side.

In this embodiment, the speed modulation coil 8 having a total length of 20 mm in the tube axis direction is used.

Figure 2:
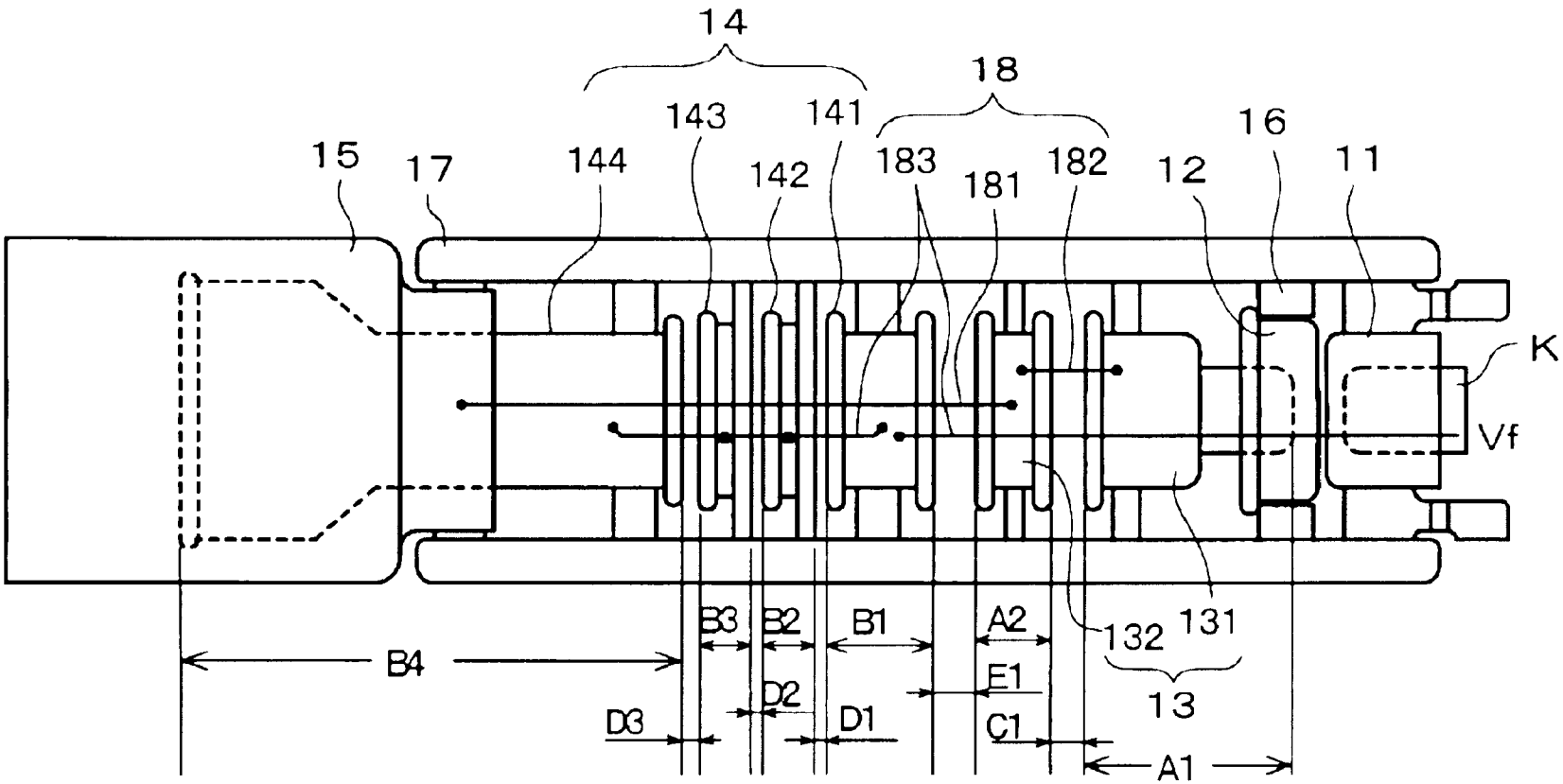
FIG. 2 is a side view of an electron gun arranged in the inside of the cathode ray tube of the present invention.

FIG. 2 is a side view of the electron gun 5 for explaining the first embodiment of the present invention. A dotted portion indicates a perspective portion. A total length of the cathode ray tube of this embodiment is 270 mm.

In the electron gun shown in FIG. 2, a cathode K, a first grid electrode (control electrode) 11, a second grid electrode (acceleration electrode) 12, a third grid electrode (front-stage anode electrode) 13, a fourth grid electrode (focus electrode) 14 and a fifth grid electrode (anode electrode) 15 are arranged along a tube axis of the cathode ray tube. These grid electrodes are respectively provided with bead supports 16. The bead supports 16 of respective electrodes are embedded into an insulation support body (bead glass) 17 so as to fix respective electrodes. Further, potentials are supplied to respective electrodes through connection lines (connectors) 18.

The cathode K, the first grid electrode 11 and the second grid electrode 12 constitute a so-called 3 pole portion which generates the electron beam.

The front-stage anode electrode 13, the focus electrode 14 and the anode electrode 15 form an electron lens for accelerating and focusing the electron beams on the phosphor screen. The electron gun 5 shown in FIG. 2 is a so-called uni-potential type electron gun. Further, a portion of the focus electrode 14 is inserted into the inside of the anode electrode 15. Due to such a constitution, a diameter of the electron lens which is constituted of the focus electrode 14 and the anode electrode 15 is enlarged.

The front-stage anode electrode 13 is divided into a first front-stage anode electrode 131 at the cathode side and a second front-stage anode electrode 132 at the phosphor screen side. A plurality of divided front-stage anode electrodes 131, 132 are arranged with a given interval in the tube axis direction of the cathode ray tube. The first front-stage anode electrode 131 and the second front-stage anode electrode 132 are electrically connected by a connection line 182 such that these anode electrodes 131, 132 assume the equal potential.

Figure 3:
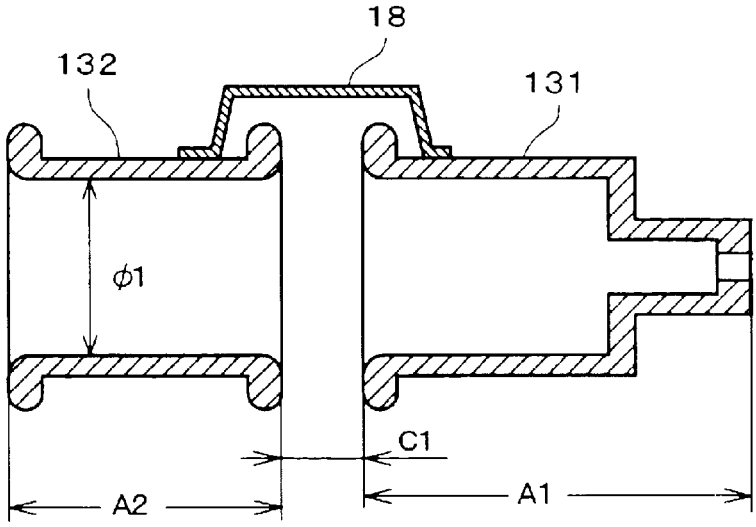
FIG. 3 is a cross-sectional view of a front-stage anode.

FIG. 3 is a cross-sectional view of the front-stage anode electrode 13. The first front-stage anode electrode 131 is a cup-shaped electrode part having two diameters which consist of a cylindrical portion with a large inner diameter and a cylindrical portion with a small inner diameter. The second front-stage anode electrode 132 is constituted of a cylindrical electrode part.

The focus electrode 14 is divided into a first focus electrode (front-stage focus electrode) 141, a second focus electrode 142, a third focus electrode 143 and a fourth focus electrode (front-stage focus electrode) 144 in the above-mentioned order from the cathode side to the phosphor screen side. A plurality of these divided focus electrodes are arranged at given intervals in the tube axis direction of the cathode ray tube. The first focus electrode 141, the second focus electrode 142, the third focus electrode 143 and the fourth focus electrode 144 are electrically connected by means of a connection line 183. A focus voltage Vf which changes a voltage thereof in synchronism with the deflection of the electron beam is applied to the focus electrode 14.

The fourth focus electrode 144 has a cathode-side small-diameter portion and a phosphor screen-side large-diameter portion. The large-diameter portion is inserted into the inside of the anode electrode 15.

Figure 4A:
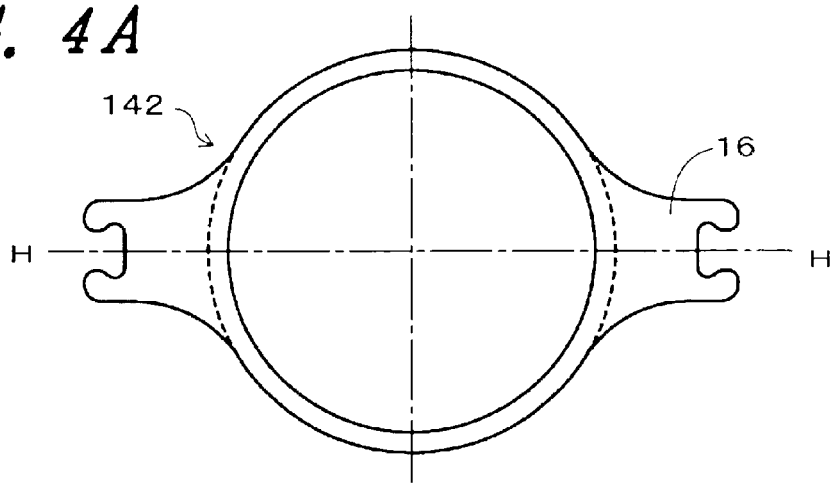
FIG. 4*a* is a front view of a second focus electrode and FIG. 4*b* is a cross-sectional view taken along a line H-H of FIG. 4*a*.
Figure 4B:
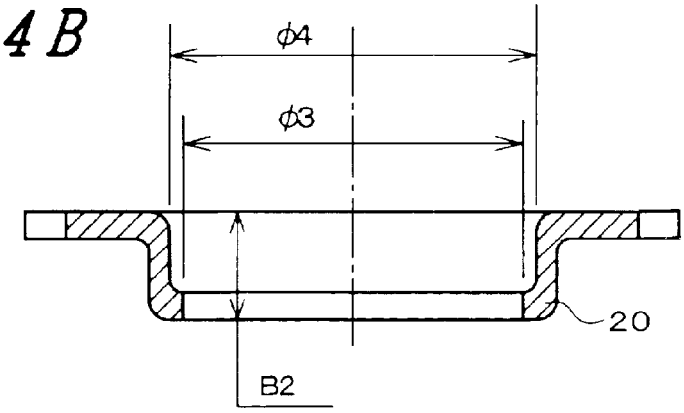

The highest anode voltage is applied to the anode electrode 15. Further, the anode electrode 15 is electrically connected FIG. 4*a* and FIG. 4*b* show one example of the second focus electrode 142, wherein FIG. 4*a* is a plan view of a cup-shaped electrode and FIG. 4*b* is a cross-sectional view taken along a line H-H of FIG. 4*a*. The cup electrode 142 is constituted by integrally forming a cup-shaped portion 20 and bead support portions 16. The cup-shaped electrode 142 has a small-diameter portion ϕ3 and a large-diameter portion ϕ4. Although one inner diameter ϕ3 and the other inner diameter ϕ4 in the drawing has a relationship of ϕ3<ϕ4 in the drawing, there is no problem even when the relationship is set to ϕ3=ϕ4. However, it is necessary that the inner diameter ϕ3 is set to equal to or more than inner diameter of ϕ1 of the first focus electrode 141.

Specific numerical values of the second focus electrode 142 shown in FIG. 4*a* and FIG. 4*b* are as follows.

First inner diameter ϕ3 of the second focus electrode: 9.9 mm

Second inner diameter ϕ4 of the second focus electrode: 11.7 mm

Plate thickness t of the second focus electrode: 0.4 mm

Figure 5A:
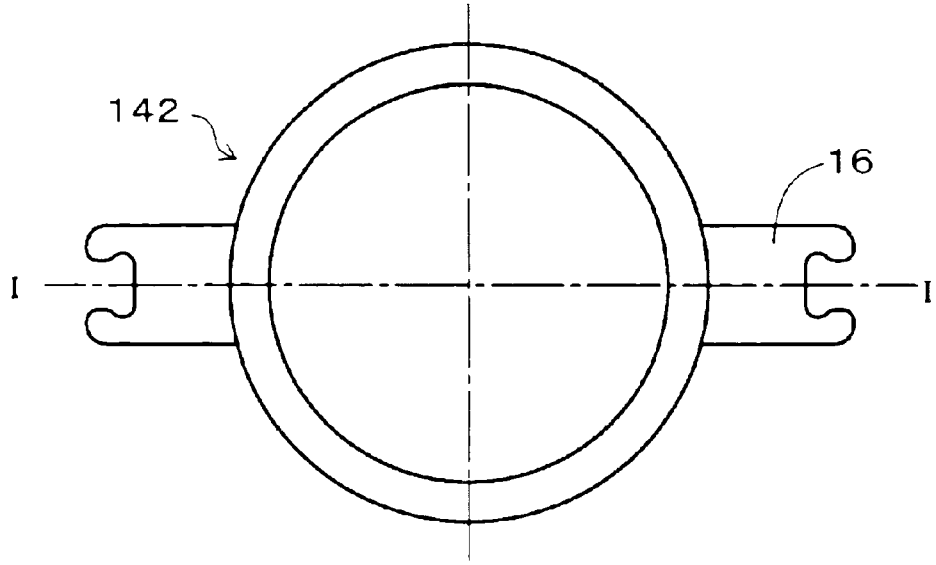
FIG. 5*a* is a front view of another example of the second focus electrode and FIG. 5*b* is a cross-sectional view taken along a line I-I of FIG. 5*a*.
Figure 5B:
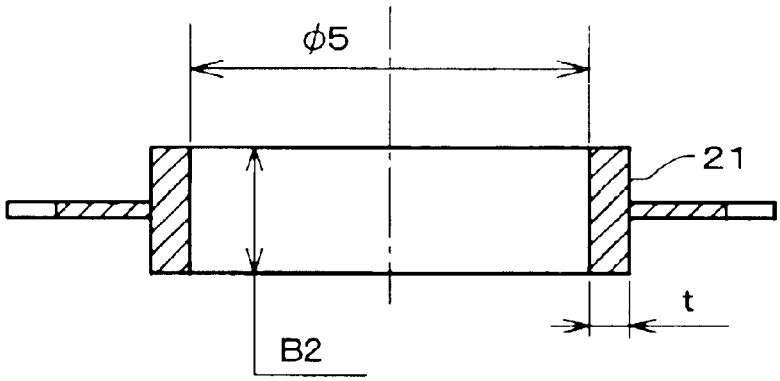

FIG. 5*a* and FIG. 5*b* show another example of the second focus electrode 142, wherein FIG. 5*a* is a plan view of a cylindrical electrode and FIG. 5*b* is a cross-sectional view taken along a line I-I of FIG. 5*a*. The second focus electrode 142 is formed by fixing bead support portions 16 to a cylindrical portion 21.

Specific numerical values of the second focus electrode 142 shown in FIG. 5*a* and FIG. 5*b* are as follows.

Inner diameter ϕ5 of the second focus electrode: 9.9 mm

Plate thickness t of the second focus electrode: 1.1 mm

The second focus electrode 142 has the greater plate thickness t at the cylindrical portion thereof compared to other electrodes. Since the thickness in the direction perpendicular to the tube axis of the cathode ray tube is large, it is possible to suppress the influence of an undesired electric field from the connection line 181 which electrically connects the front-stage anode electrode 13 and the anode electrode 15.

Figure 6A:
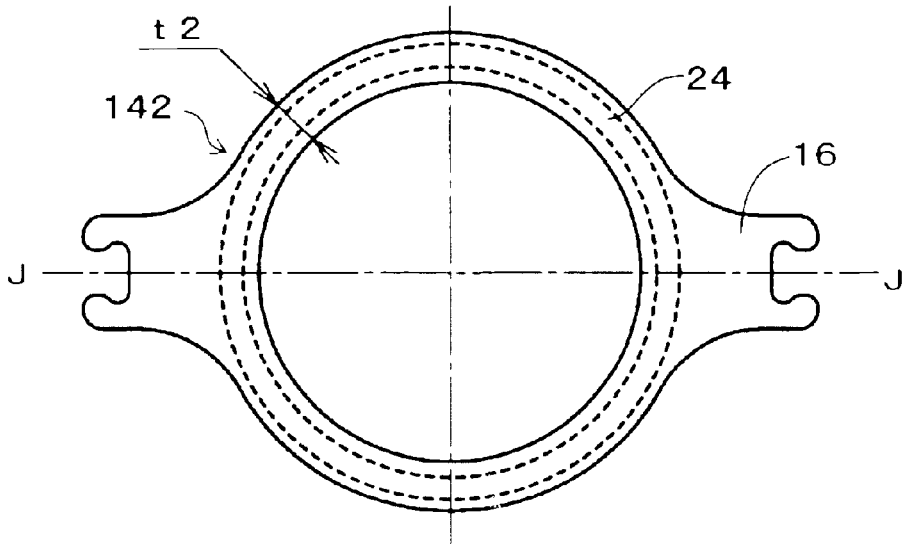
FIG. 6*a* is a front view of another example of the second focus electrode and FIG. 6*b* is a cross-sectional view taken along a line J-J of FIG. 6*a*.
Figure 6B:
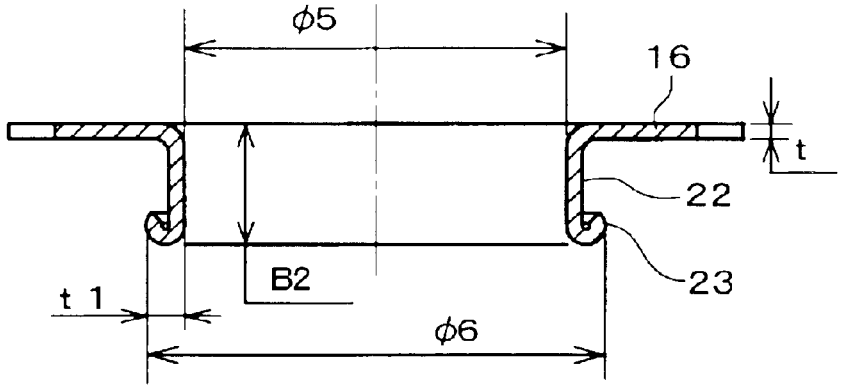

FIG. 6*a* is a plan view of the second focus electrode 142 shown in FIG. 2 and FIG. 6*b* is a cross-sectional view taken along a line J-J of FIG. 6*a*. The cylindrical electrode has a flange portion 24 and bead support portions 16 at one end thereof and a curl portion 23 which is bent to the outside of the cylindrical portion 22 at the other end thereof. The flange portion 24 and the bead support portions 16 are extended in the direction perpendicular to the tube axis. Further, the cylindrical electrode 142 is constituted by integrally forming the cylindrical portion 22, the curl portion 23, the flange portion 24 and the bead support portions 16.

Specific numerical values of the second focus electrode 142 shown in FIG. 6*a* and FIG. 6*b* are as follows.

Inner diameter ϕ5 of the second focus electrode: 9.9 mm

Plate thickness t of the second focus electrode: 0.4 mm

Outer diameter ϕ6 of curl portion of the second focus electrode: 12.2 mm

Height t1 of curl portion from inner wall of the cylindrical portion: 1.15 mm Height t2 of flange 24: 1.4 mm With the provision of the curl portion 23, it is possible to suppress the deformation of the second focus electrode 142. Further, with the provision of the curl portion 23, the length in the direction perpendicular to the tube axis of the cathode ray tube is elongated. That is, it is possible to obtain an advantageous effect which is equal to the advantageous effect obtained by increasing the plate thickness t in FIG. 5*a* and FIG. 5*b*. Further, the plate thickness of the second focus electrode 142 shown in FIG. 6*a* and FIG. 6*b* is smaller than the plate thickness of the second focus electrode 142 shown in FIG. 5*a* and FIG. 5*b* and hence, the electrode can be formed easily.

An advantage of the cylindrical electrode shown in FIG. 6*a* and FIG. 6*b* lies in that the cylindrical electrode can reduce the strain of electron beams more effectively compared to the cup-shaped electrode.

Further, although the curl portion 23 which is bent to the outside of the cylindrical portion 22 is formed on one end of the cylindrical electrode in FIG. 6*a* and FIG. 6*b*, a flange which is extended perpendicular to the tube axis may be formed on one end of the cylindrical electrode.

The total length B2 of each electrode shown in FIG. 4*b*, FIG. 5*b* or FIG. 6*b* is shorter than the length of other electrodes. By arranging the electrode having the short total length in the region on which the speed modulation magnetic field acts, an eddy current generated on the electrode can be reduced.

The bead support 16 of the second focus electrode is embedded in the insulation support body 17. Here, since a distance between the neighboring electrodes is small, there is a possibility that the insulation support body 17 cracks. To avoid the occurrence of cracks in the insulation support body 17, end portions of bead support 16 are made thinner than other portions.

Although the second focus electrode 142 is formed in a cylindrical shape in this embodiment, the second focus electrode 142 may be formed of a plate-like or cup-shaped electrode.

Figure 7A:
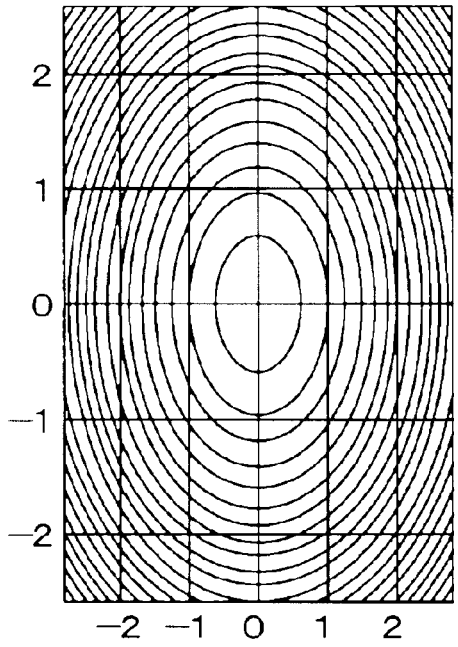
FIG. 7*a* is a view showing the distribution of an electric field generated in a gap between a first focus electrode and the second focus electrode in the electron gun shown in FIG. 2.
Figure 7B:
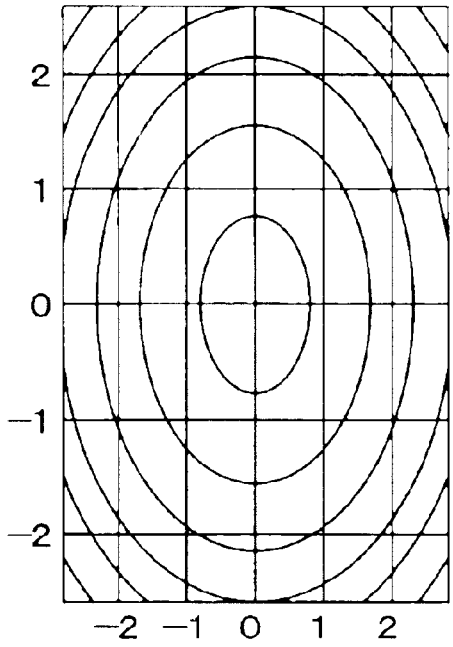
FIG. 7*b* is a view showing the distribution of an electric field generated in a gap between the second focus electrode and a third focus electrode.
Figure 7C:
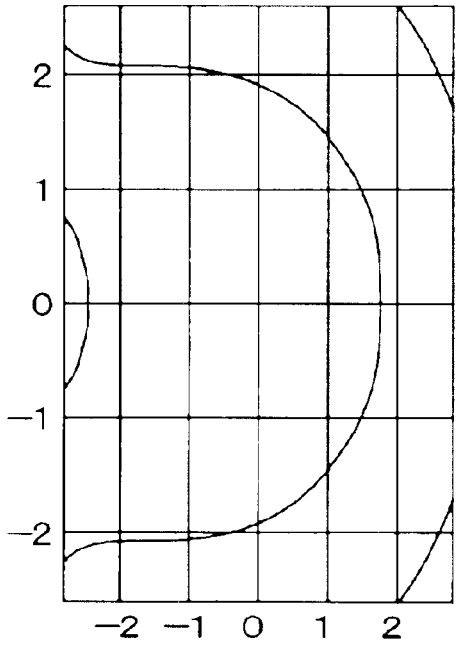
FIG. 7*c* is a view showing the distribution of an electric field generated in a gap between the third focus electrode and a fourth focus electrode.

FIG. 7*a*, FIG. 7*b* and FIG. 7*c* respectively show a result of measurement of the electric field distribution in the electron gun shown in FIG. 2. FIG. 7*a* shows the result of the measurement at an intermediate portion of a gap D1 between the first focus electrode 141 and the second focus electrode 142, FIG. 7*b* shows the result of the measurement at an intermediate portion of a gap D2 between the second focus electrode 142 and the third focus electrode 143, and FIG. 7*c* shows the result of the measurement at an intermediate portion of a gap D3 between the third focus electrode 143 and the fourth focus electrode 144.

In FIG. 7*a*, FIG. 7*b* and FIG. 7*c*, an intersection of 0 axis on the axis of ordinates and 0 axis on the axis of abscissas constitutes the tube axis of the cathode ray tube. A center portion of the bead glass is positioned on an extension line of the 0 axis on the axis of ordinates. The connection line which electrically connects the front-stage anode electrode 13 and the anode electrode 15 (hereinafter referred to as "anode contact line") 181 is positioned on the leftward extension line of the 0 axis on the axis of abscissas.

At the intermediate portion of the gap D1 between the first focus electrode 141 and the second focus electrode 142 shown in FIG. 7*a*, the influence of the front-stage anode electrode 13 is strong and hence, the equipotential lines are dense. The electric field is extended in the bead support arranging direction. Further, the electric field of this portion hardly receives the influence of the anode connection line 181.

At the intermediate portion of the gap D2 between the second focus electrode 142 and the third focus electrode 143 shown in FIG. 7*b*, the electric field is extended in the bead support arranging direction. Further, the electric field of this portion receives the influence of the anode connection line 181 so that the distance between the equipotential lines slightly differs between the right side and the left side of the tube axis on the 0 axis of the axis of abscissas.

At the intermediate portion of the gap D3 between the third focus electrode 143 and the fourth focus electrode 144 shown in FIG. 7*c*, the electric field of this portion receives the influence of the anode connection line 181 and the shape of the electric field differs between the right side and the left side of the tube axis. However, since the distance of the equipotential lines is coarse, the influence of the electric field to the electron beam is small and hence, the deformation of the electron beam is small.

FIG. 8 shows a result of the measurement of the electric field distribution when a cylindrical electrode having no curl portion is used as the second focus electrode 142 and the third focus electrode 143. Other conditions are equal to those of the electron gun 5 measured in FIG. 7.

Figure 8A:
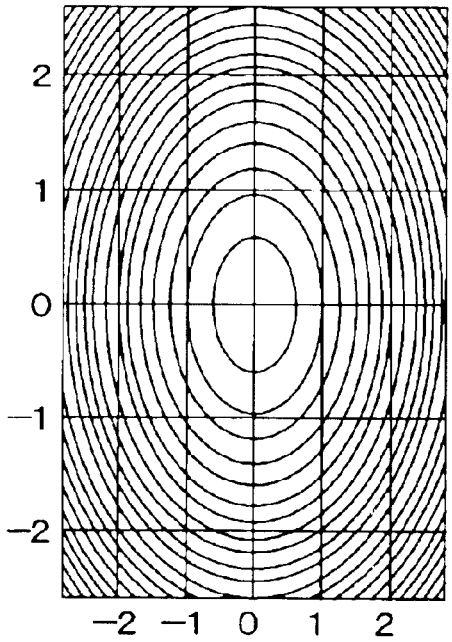
FIG. 8*a* is a view showing the distribution of an electric field generated in a gap between a first focus electrode and a second focus electrode of an electron gun having focus electrodes with no curling portions.
Figure 8B:
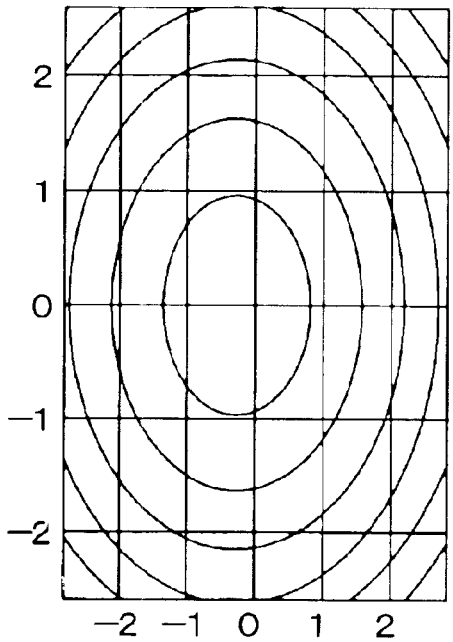
FIG. 8*b* is a view showing the distribution of an electric field generated in a gap between the second focus electrode and a third focus electrode.
Figure 8C:
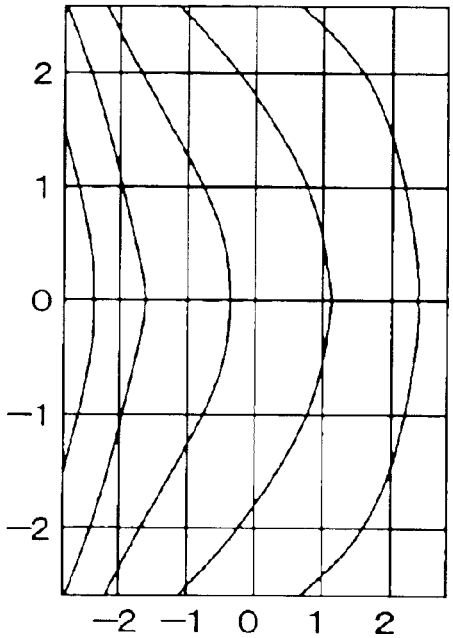
FIG. 8*c* is a view showing the distribution of an electric field generated in a gap between the third focus electrode and a fourth focus electrode.

FIG. 8*a* shows the result of the measurement at an intermediate portion of a gap D1 between the first focus electrode 141 and the second focus electrode 142, FIG. 8*b* shows the result of the measurement at an intermediate portion of a gap D2 between the second focus electrode 142 and the third focus electrode 143, and FIG. 8*c* shows the result of the measurement at an intermediate portion of a gap D3 between the third focus electrode 143 and the fourth focus electrode 144.

At the intermediate portion of the gap D1 between the first focus electrode 141 and the second focus electrode 142 shown in FIG. 8*a,* the electric field is extended in the bead support arranging direction. Further, the electric field of this portion receives the influence of the anode connection line 181 so that the center N1 of the equipotential lines is displaced to the left side of the center of tube axis.

At the intermediate portion of the gap D2 between the second focus electrode 142 and the third focus electrode 143 shown in FIG. 8*b,* the electric field receives the influence of the anode connection line 181 and hence, the center N1 of the equipotential lines is displaced to the left side of the center of the tube axis. Further, the distance between the equipotential lines differs between the right side and the left side of the tube axis on the 0 axis of the axis of abscissas.

At the intermediate portion of the gap D3 between the third focus electrode 143 and the fourth focus electrode 144 shown in FIG. 8*c,* the electric field receives the influence from the anode connection line 181 and the shape of the electric field differs between the right side and the left side of a tube axis.

Due to such a constitution, by forming the flange portion on one end of the cylindrical electrode and the curl portion on the other end of the cylindrical electrode, it is possible to reduce the influence which the electron beams receive from the anode connection line 181.

Since the potential difference of approximately 23 kV is present between the anode voltage and the focus voltage, it is preferable to set the flange or the curl potion and the anode connection line 181 apart from each other by equal to or more than 2 mm.

Figure 9:
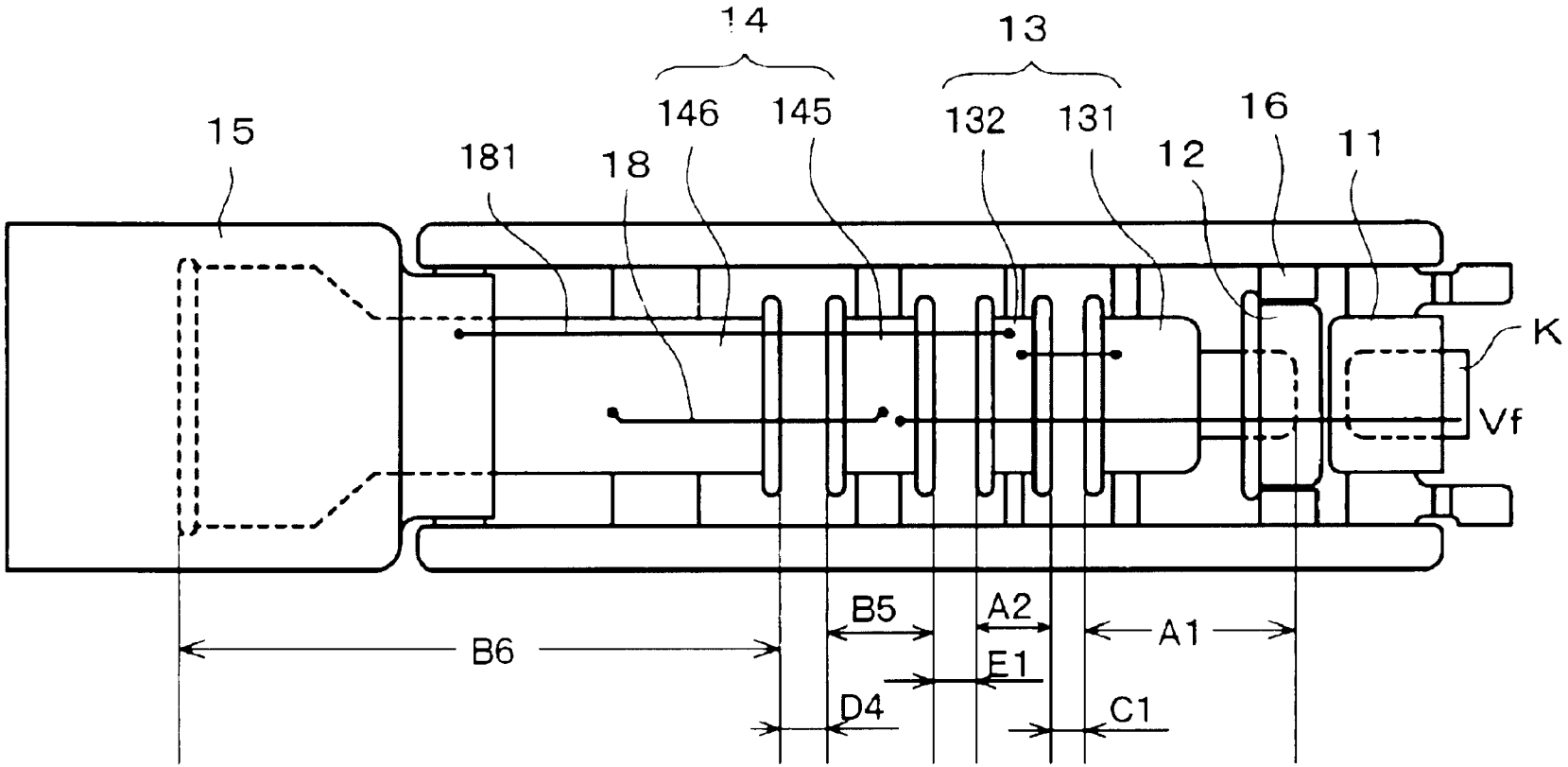
FIG. 9 is a side view of an electron gun arranged in the inside of a cathode ray tube according to a second embodiment of the present invention.

FIG. 9 is a side view of an electron gun for explaining the second embodiment of the present invention. Parts which have equal functions as those shown in FIG. 2 are indicated by the same numerals. A front-stage anode electrode 13 and a focus electrode 14 shown in FIG. 9 respectively have one gap.

With respect to a cathode ray tube of this embodiment, the total length L thereof is shortened compared to a conventional cathode ray tube. Since a diagonal size of a panel portion and a deflection angle of electron beams are equal to those of the conventional cathode ray tube, the total length of a neck portion L1 is particularly shortened. The total length of the conventional general cathode ray tube is 270 mm. The present invention is particularly effective with respect to a cathode ray tube of short total length such as the cathode ray tube having the total length of equal to or less than 260 mm. The total length of the cathode ray tube can be shortened to 240 mm by shortening the length of the focus electrode 14, the length of a rear stage anode and the length of a shield cup.

The total length L of the cathode ray tube of this embodiment is 255 mm. Further, this embodiment shortens the total length of the focus electrode.

Since the neck portion is short, a portion of the anode of the electron gun is inserted in a region of a deflection yoke. Accordingly, a speed modulation coil 8 is arranged in a region which is overlapped with the focus electrode 14 and the front-stage anode 13 in the tube axis direction. Further, the focus electrode 14 and the front-stage anode electrode 13 are respectively provided with gaps. An magnetic field generated by the speed modulation coil 8 enters these gaps and reaches an electron beam passing region. The gaps which are respectively provided to the focus electrode 14 and the front-stage anode electrode 13 constitute the gaps for scanning speed modulation of electron beams (VM gap).

The front-stage anode electrode 13 is divided into a first front-stage anode electrode 131 at the cathode side and a second front-stage anode electrode 132 at the phosphor screen side. The first front-stage anode electrode 131 and the second front-stage anode electrode 132 are electrically connected by means of an anode connection line 181 such that these electrodes 131, 132 assume the equipotential. The shape of the front-stage anode electrode is as same as that of the first embodiment.

The focus electrode 14 is divided into a front-stage focus electrode 141 and a rear-stage focus electrode 144 in this order from the cathode side to the phosphor screen side. The front-stage focus electrode 141 is constituted of a cylindrical electronic part.

The front-stage focus electrode 141 and the rear-stage focus electrode 146 are electrically connected by means of a connection line 18. A focus voltage Vf which changes a voltage thereof in synchronism with the deflection of the electron beams is applied to the focus electrode 14.

The rear-stage focus electrode 146 has a small inner-diameter cylindrical portion at the cathode side and a large inner-diameter cylindrical portion at the phosphor screen side. The large inner-diameter cylindrical portion is inserted into the inside of the anode electrode 15.

The highest anode voltage is applied to the anode electrode 15. Further, the anode electrode 15 is electrically connected to the front-stage anode electrode 13 by means of the connection lines 181.

The total length of the focus electrode 14 shown in FIG. 9 is shorter than the total length of the focus electrode 14 shown in FIG. 2. In this embodiment, by shortening the total length of the focus electrode 14, the total length of the color cathode ray tube is shortened.

Specific sizes of the electron gun of this embodiment are as follows.

Total length A1 of the first front-stage anode 131=14.5 mm

Total length A2 of the second front-stage anode 132=5.0 mm

Total length B5 of the front-stage focus electrode 145=5.0 mm

Total length B6 of the rear-stage focus electrode 146=32.5 mm

Gap C1 between the first front-stage anode 131 and the second front-stage anode 132=1.0 mm Gap D4 between the front-stage focus electrode 145 and the rear-stage focus electrode 146=1.0 mm Distance E1 between the second front-stage anode 132 and the front-stage focus electrode 145=2.0 mm Inner diameter of the second front-stage anode 132=inner diameter $\phi$1 of the front-stage focus electrode 145=9.9 mm Inner diameter $\phi 2$ of large-diameter portion of the rear-stage focus electrode=15.8 mm Here, manufacturing tolerance is 0.1 mm.

The length extending from a phosphor-screen side end portion of the first front-stage anode 131 to a cathode-side end portion of the rear-stage focus electrode 146 (C1+A2+E1+B5+D4) is 14 mm. The length extending from the phosphor-screen side end portion of the first front-stage anode 131 to a cathode-side end portion of the fourth focus electrode 144 is set in a range of length which is shorter than the total length of the speed modulation coil.

With the provision of the cathode ray tube using the electron gun having the constitution of this embodiment, a magnetic field which is generated by the speed modulation coil efficiently enters the gap of the front-stage anode and the gap of the focus electrode and acts on electron beams.

According to the present invention, since the gaps are respectively formed in the front-stage anode electrode 13 and the focus electrode 14, the gap formed in the focus electrode 14 can be made small. Accordingly, the influence of the electric field from the insulation support body 17 and the connection line can be reduced.

Further, since the gaps (VM gaps) which increase the speed modulation effect are provided to the focus electrode 14 and the front-stage anode electrode 13, even when the center position of the speed modulation coil is arranged at the center of the gap E1 between the second front-stage anode 132 and the front-stage focus electrode 145, it is possible to obtain the sufficient speed modulation effect. Accordingly, even when the total length of the electron gun is shortened, the reduction of the contrast can be suppressed.

Figure 10:
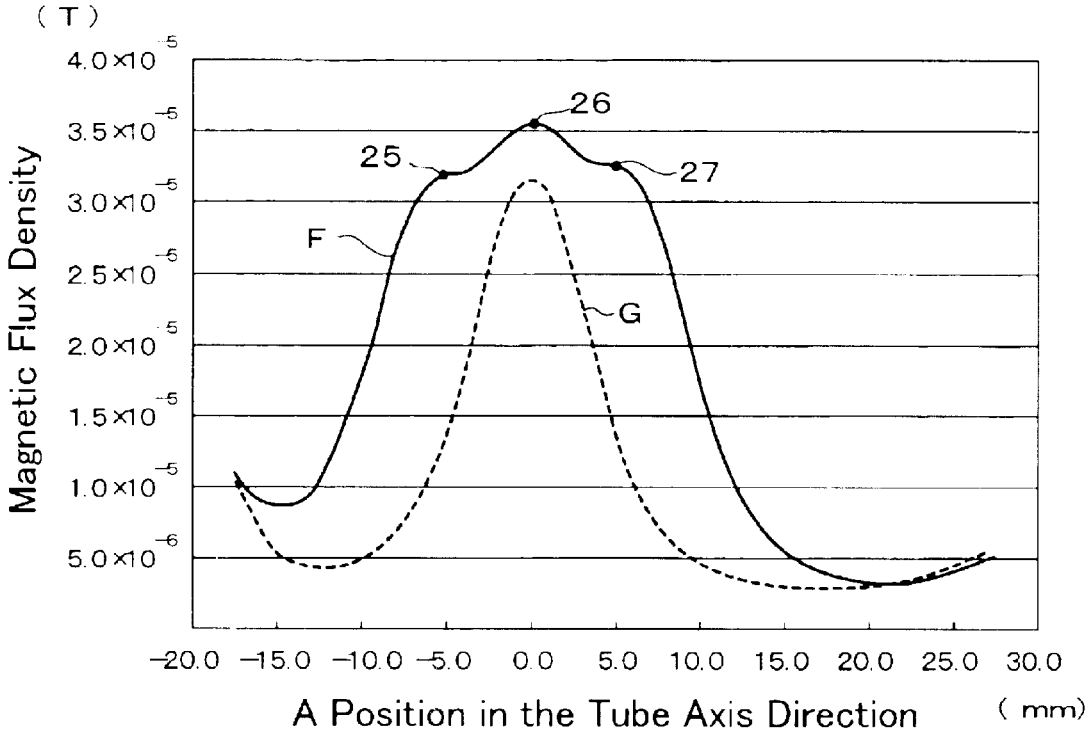
FIG. 10 is a view showing the relationship between speed modulation sensitivity and a distance in the tube axis direction of electrodes of the electron gun.

FIG. 10 is a characteristic view of the speed modulation sensitivity in the cathode ray tube using the electron gun shown in FIG. 9. A position in the tube axis direction in the cathode ray tube is taken on the axis of abscissas and the magnetic flux density in the vicinity of the tube axis is taken on the axis of ordinates. The center portion of the gap E1 in the tube axis direction constitutes the reference, wherein the cathode direction assumes a minus (−) value. The speed modulation effect is a general effect consisting of the speed modulation effects obtained by the magnetic field which enters the gap formed in the front-stage anode electrode 13, the magnetic field which enters the gap between the front-stage anode electrode and the focus electrode, and the magnetic field which enters the gap formed in the focus electrode 14. Here, the speed modulation coil having a length of 20 mm is used and the center of the speed modulation coil is arranged in the center portion of the gap E1 in the tube axis direction.

A curve F indicates a distribution of magnetic flux density in the electron gun of this embodiment. With respect to this curve F, numeral 25 indicates a peak value of the density of magnetic flux which enters an electron beam path through the gap C1 of the front-stage anode electrode 13, numeral 26 indicates a peak value of the density of magnetic flux which enters the electron beam path by the gap E1 between the front-stage anode electrode 13 and the focus electrode 14, and numeral 27 indicates a peak value of the density of magnetic flux which enters the electron beam path by the gap D4 of the focus electrode 14.

Further, with respect to the curve F, a portion having a gentle inclination is formed between the peak portion 26 and the peak portion 27 due to the influence derived from the first focusing electrode, while a portion having a gentle inclination is formed between the peak portion 25 and the peak portion 26 due to the influence derived from the second front-stage anode electrode.

Since the gap C1 of the front-stage anode electrode 13 and the gap D4 of the focus electrode 14 are formed close to the gap E1 between the front-stage anode electrode 13 and the focus electrode 14, the influence derived from the second front-stage anode electrode 132 and the first focus electrode 145 is small and hence, the decrease of the magnetic flux which enters the electron beam path can be suppressed. The speed modulation effect depends on an integrated value of the magnetic field from the speed modulation coil. Accordingly, by forming the gap of the front-stage anode electrode 13 and the gap of the focus electrode 14 close to the gap between the front-stage anode electrode 13 and the focus electrode 14, the speed modulation effect can be largely enhanced.

The curve G indicates the distribution of magnetic flux density of an electron gun provided with only the gap E1.

Due to the constitution of this embodiment, the magnetic field generated by the speed modulation coil passes through the gaps formed in the front-stage anode electrode 13 and the focus electrode 14 and can realize a given speed modulation. At the same time, an eddy current which is generated in the focus electrode due to the magnetic field generated by the speed modulation coil can be reduced and hence, the reduction of the speed modulation effect can be suppressed.

Accordingly, it is possible to display images which has enhanced a contrast.

According to the above-mentioned embodiment, it is possible to shorten the total length of the neck portion by shifting the electron gun toward the phosphor screen side. Further, the total length of the cathode ray tube can be shortened.

The electron gun of this embodiment can shorten the total length of the electrode parts which constitute the focus electrode 14 and the total length of the electrode parts which constitute the front-stage anode electrode 13 respectively and hence, it is possible to prevent the deformation of the electrodes.

Since the electron gun can be shifted to the phosphor screen side, the distance between the large-diameter electron lens and the phosphor screen can be shortened whereby the focusing is enhanced.

Figure 11:
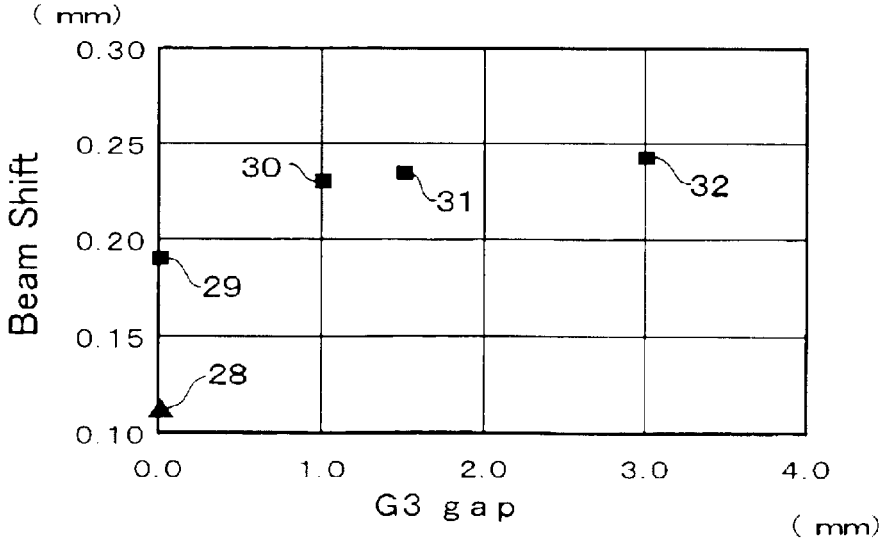
FIG. 11 is a view showing the relationship between a gap of a front-stage anode and a shifting amount of electron beams.

FIG. 11 is a view showing the relationship between a distance (G3gap) of the gap C1 formed in the front-stage anode 13 and a shifting amount (Beam Shift) of the electron beams on the phosphor screen, wherein the shifting amount when an electric current is applied to the speed modulation coil and the shifting amount when an electric current is not applied to the speed modulation coil are shown.

A point 28 indicates the shifting amount of the electron beam of a cathode ray tube with an electron gun which has neither the gap C1 nor the gap C4, a point 29 indicates the shifting amount of the electron beam of a cathode ray tube with an electron gun which has the gap D4 and does not have the gap C1, and a point 30, a point 31 and a point 32 indicate the shifting amount of the electron beam of a cathode ray tube with an electron gun which has the gaps C1, C4. Further, the gap C1 is set to 1.0 mm at the point 30, the gap C1 is set to 1.5 mm at the point 31, and the gap C1 is set to 3.0 mm at the point 32. With respect to the electron gun provided with the gap C1, the distance of the gap C1 is changed by changing the size of the first front-stage anode.

A shifting amount of an electron beam spot (hereinafter referred to as "beam shifting amount") of the cathode ray tube having the electron gun which has neither the gap C1 nor the gap D4 is approximately 0.11 mm. The beam shifting amount of cathode ray tube having the electron gun which has the gap D4 and does not have the gap C1 is approximately 0.19 mm. The beam shifting amount of the cathode ray tube having the electron gun which has the gap D4 and also has the gap C1 of 1.0 mm is approximately 0.23 mm. The beam shifting amount of the cathode ray tube having the electron gun which has the gap D4 and also has the gap C1 of 1.5 mm is approximately 0.234 mm. The beam shifting amount of the cathode ray tube having the electron gun which has the gap D4 and also has the gap C1 of 3.0 mm is approximately 0.242 mm.

In the above-mentioned experiment, the gap D4 is set to 1.0 mm.

On a screen to which images are projected, the electron beam shifting amount of the electron beam spot becomes approximately 10 times as large as the shifting amount on the phosphor screen. For example, when the electron beam spot shifts approximately 0.23 mm on the phosphor screen, the electron beam spot shifts approximately 2.3 mm on the screen.

With the increase of the electron beam shifting amount, when the signal level is changed in the order of dark, bright and dark, for example, by applying the modulated voltage VM, the bright portion on the screen is displayed in a narrower manner on the phosphor screen. This implies that the speed modulation effect appears in a larger amount.

That is, in the case where the signal level is changed from dark to bright, when the scanning is accelerated temporarily, the beam shifting amount is increased correspondingly. To the contrary, in the case where the signal level is changed from bright to dark, the scanning is performed slowly at a fall of the signal and thereafter the scanning is accelerated to largely shift the beams. On the screen, the dark portions are enlarged and a picture which appears to have enhanced the contrast is created.

By providing the gaps to the front-stage anode and the focus electrode respectively. the generation of the eddy current which is derived from the speed modulation magnetic field can be suppressed whereby the speed modulation magnetic field can be effectively utilized.

Although the gap C1 between the first front-stage anode 131 and the second front-stage anode 132 is set to 1.0 mm in the above-mentioned embodiment, the gap C1 may be set within a range of 0.5 mm to 1.5 mm. That is, the VM gap may be set within a range of 0.5 mm to 1.5 mm.

When the VM gap is set smaller than 0.5 mm, the entrance of the magnetic field to the electron beam path becomes smaller and hence, the speed modulation effect is reduced. Further, the electrode is elongated by an amount corresponding to the decrease of the VM gap and hence, the generation of the eddy current is increased whereby the speed modulation effect is reduced.

When the VM gap is set larger than 1.5 mm, an undesired magnetic field or an undesired electric field enters the electron beam path and hence, the electron beams are deformed.

Figure 12:
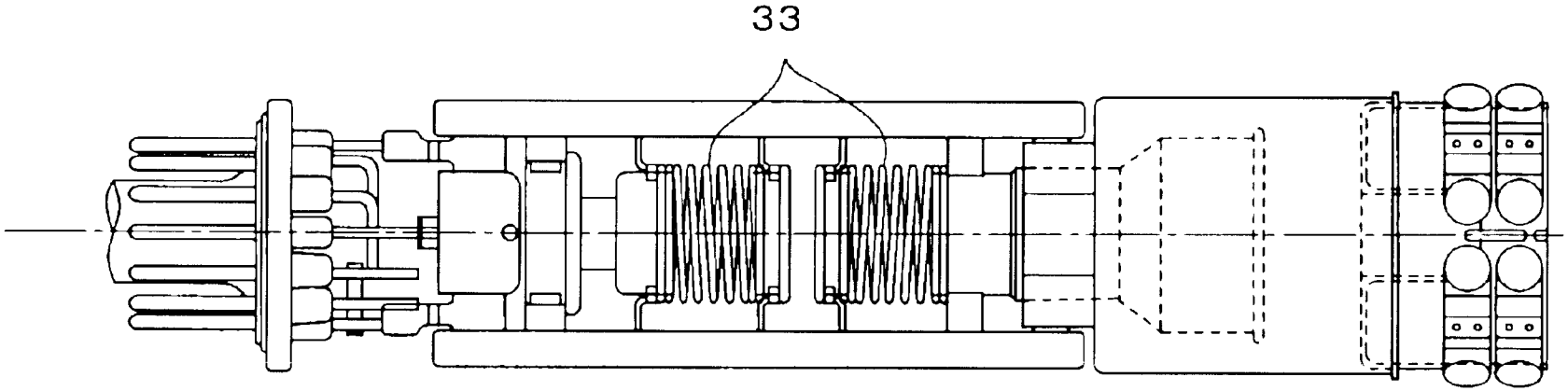
FIG. 12 is a side view of an electron gun for explaining a modification of the second embodiment of the present invention.

FIG. 12 is a modification of the second embodiment. A spring-like connection line 33 may be used in the gap C1 and the gap D4. Although there exists a problem that the spring-like connection line 33 is liable to be easily deformed so that the handling thereof is difficult, the spring-like connection line 33 can largely suppress the generation of the eddy current.

Figure 13:
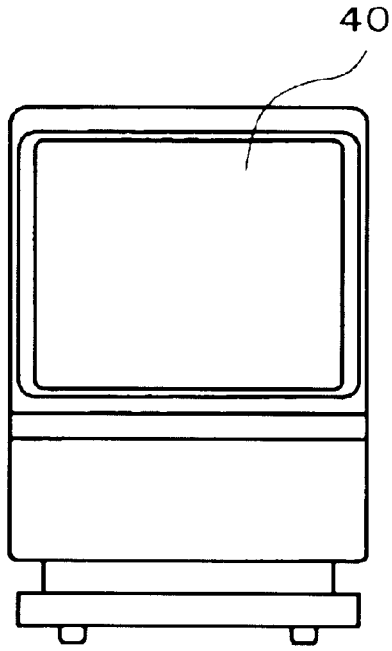
FIG. 13 is a front view of a projection-type image display device using a cathode ray tube.
Figure 14:
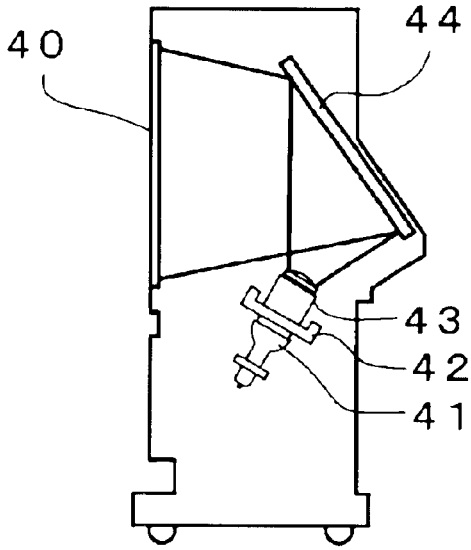
FIG. 14 is an inner side view of the projection-type image display device using the cathode ray tube.
Figure 15:
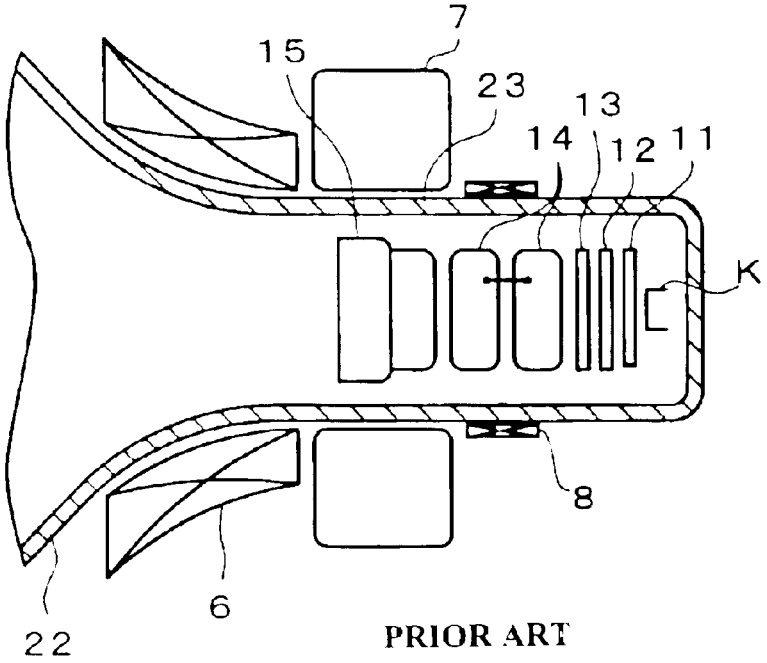
FIG. 15 is a cross-sectional view of an essential part of a conventional cathode ray tube adopting an electromagnetic speed modulation method.
Figure 16:
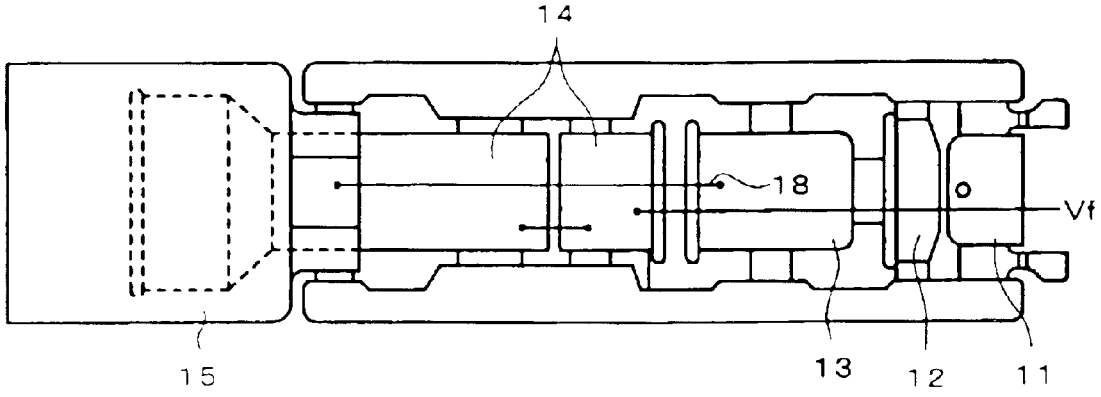
PRIOR ART FIG. 16
FIG. 16 is a side view of the conventional electron gun adopting the speed modulation method.

FIG. 13 is a front view of a projection type image display device using the cathode ray tube of the present invention and FIG. 14 is an inner side view for schematically explaining the inner structure of image display device shown in FIG. 13. In these drawings, numeral 40 indicates a screen, numeral 41 indicates a cathode ray tube (projection type cathode ray tube), numeral 42 indicates an optical connector and numeral 43 indicates a projection optical system, and numeral 44 indicates a mirror.

In this projection type image display device (more specifically, projection type television receiver set), an image formed on a phosphor screen applied to a panel portion of the cathode ray tube 41 is magnified by the projection optical system 43 which is mounted on the panel portion by way of the connector 42, and thereafter, the magnified image is projected to the screen 40 through the mirror 44. In performing a color image display, cathode ray tubes which respectively display images of red, green and blue are necessary. A correction magnetic device is used for convergence adjustment of image of three cathode ray tubes.

According to such a projection type television receiver set, an image on the large screen of equal to or more than 40 inches, for example, can be reproduced with high image quality.

The present invention is not limited to the above-mentioned monochroic cathode ray tube and is applicable to a direct-type color cathode ray tube having a plurality of electron beams and a phosphor body of a plurality of colors and other various types of cathode ray tubes in the same manner.

In the above-mentioned embodiment, the gaps for enhancing the speed modulation sensitivity are provided to the front-stage anode electrode 13 and the focus electrode 14 respectively. However, in place of the above-mentioned gap, a helical connection line which surrounds the electron beam path may be arranged in either one or both of the front-stage anode electrode 13 and the focus electrode 14.

As has been described heretofore, the present invention can shorten the entire length of the cathode ray tube and also can enhance the contrast.

Further, according to the present invention, even with respect to the cathode ray tube in which it is difficult to arrange the speed modulation coil close to the main lens due to short total length of the neck portion, it is possible to obtain the sufficient speed modulation effect. Further, the present invention can obtain the sufficient speed modulation effect even when the electron gun has the short focus electrode.

What is claimed is:

1. A cathode ray tube comprising an evacuated envelope which is constituted of a panel portion on which a phosphor screen is formed, a neck portion which houses an electron gun and a funnel portion which connects the panel portion and the neck portion, wherein the electron gun has a cathode, a control electrode, an acceleration electrode, a front-stage anode electrode divided into a plurality of electrodes, and an anode electrode, the plurality of divided front-stage anode electrodes are arranged at given intervals in a tube axis direction of the cathode ray tube, a plurality of divided focus electrodes arranged at given intervals in the tube axis direction of the cathode ray tube, wherein an anode voltage, which is the highest voltage applied to the electron gun, is applied to the front-stage anode electrode and the anode electrode, and a focus voltage is applied to the focus electrode, and wherein the front-stage anode electrode is divided into halves and the focus electrode is divided into quarters.

2. A cathode ray tube according to claim 1, wherein a distance between divided halves of the front-stage anode electrode is in the range from equal to or more than approximately 0.5 mm to equal to or less than approximately 1.5 mm.

3. A cathode ray tube comprising an evacuated envelope which is constituted of a panel portion on which a phosphor screen is formed, a neck portion which houses an electron gun and a funnel portion which connects the panel portion and the neck portion, wherein the electron gun has a cathode, a control electrode, an acceleration electrode, a front-stage anode electrode divided into a plurality of electrodes, and an anode electrode, the plurality of divided front-stage anode electrodes are arranged at given intervals in a tube axis direction of the cathode ray tube, a plurality of divided focus electrodes arranged at given intervals in the tube axis direction of the cathode ray tube, wherein an anode voltage, which is the highest voltage applied to the electron gun, is applied to the front-stage anode electrode and the anode electrode, and a focus voltage is applied to the focus electrode, and wherein said cathode, said control electrode, said acceleration electrode, said front-stage anode electrode divided into a plurality of electrodes, said focus electrode divided into a plurality of electrodes, and said anode electrode are arranged in the above-listed order from the cathode side to the phosphor screen side in said tube axis direction.

4. A cathode ray tube comprising an evacuated envelope which is constituted of a panel portion on which a phosphor screen is formed, a neck portion which houses an electron gun and a funnel portion which connects the panel portion and the neck portion, wherein the electron gun has a cathode, a control electrode, an acceleration electrode, a front-stage anode electrode divided into a plurality of electrodes, and an anode electrode, the plurality of divided front-stage anode electrodes are arranged at given intervals in a tube axis direction of the cathode ray tube, a plurality of divided focus electrodes arranged at given intervals in the tube axis direction of the cathode ray tube, wherein an anode voltage, which is the highest voltage applied to the electron gun, is applied to the front-stage anode electrode and the anode electrode, and a focus voltage is applied to the focus electrode, and wherein a portion of said focus electrode is inserted into an inside portion of said anode electrode.

* * * * *